US007678982B2

(12) United States Patent
Adams

(10) Patent No.: US 7,678,982 B2
(45) Date of Patent: Mar. 16, 2010

(54) DEVICE AND METHOD FOR AUTOMATIC TUNING OF A STRING INSTRUMENT IN PARTICULAR A GUITAR

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 0 days.

(21) Appl. No.: 11/568,540

(22) PCT Filed: Jan. 19, 2005

(86) PCT No.: PCT/EP2005/000477

§ 371 (c)(1),
(2), (4) Date: Jun. 1, 2007

(87) PCT Pub. No.: WO03/012774

PCT Pub. Date: Feb. 13, 2003

(65) Prior Publication Data

US 2008/0006140 A1 Jan. 10, 2008

(30) Foreign Application Priority Data

May 13, 2004 (EP) ..... 04011357

(51) Int. Cl.
*G10G 7/02* (2006.01)
*G10D 3/14* (2006.01)

(52) U.S. Cl. ..... 84/455; 84/7; 84/9; 84/173; 84/267; 84/312 R; 84/602; 84/604; 84/654

(58) Field of Classification Search ..... 84/7–9, 84/107, 112–114, 122–135, 144, 173, 263, 84/267, 455

See application file for complete search history.

(56) References Cited

U.S. PATENT DOCUMENTS 3,130,626 A 4/1964 Martin 3,813,983 A 6/1974 Paul (Continued)

FOREIGN PATENT DOCUMENTS

AT 006 906 U1 5/2004

(Continued)

*Primary Examiner*—Jeffrey Donels
*Assistant Examiner*—Christopher Uhlir
(74) *Attorney, Agent, or Firm*—Hunton & Williams LLP

(57) ABSTRACT

A device and method for automatic tuning of a string Instrument, in particular, a guitar, comprising a recording device, for recording a tone generated by striking a string and for the output of a digital signal corresponding to the recorded tone, a memory device for storage of given digital signals which correspond to a desired tone, a comparator device for comparison of the digital signal output by the recording device with a digital signal corresponding to the desired tone stored in the memory device, an adjuster device for altering the tension of the strings, at least one actuator, for operating the adjuster device, a controller connected to the comparator device, which controls the at least one actuator using a bus line, by means of a difference determined in the comparator device between the signals representing the generated tone and the desired tone. The above is improved with relation to conventional techniques in so far as the above may be integrated in an instrument, in particular, a guitar, with minimal effect on the sound properties and with the smallest and least possible number of elements. The controller and the at least one actuator are arranged in the string instrument, on opposing sides of the strings viewed in the longitudinal direction of the strings and a string, made from a conducting material or wound or coated with such, is used as bus line between the controller and the at least one actuator. Furthermore, a method for the automatic tuning of a string instrument is disclosed.

11 Claims, 9 Drawing Sheets

U.S. PATENT DOCUMENTS

| | | | | | |
|---|---|---|---|---|---|
| 4,018,124 | A | * | 4/1977 | Rosado | 84/723 |
| 4,088,052 | A | * | 5/1978 | Hedrick | 84/454 |
| 4,128,033 | A | | 12/1978 | Petillo | |
| 4,197,779 | A | | 4/1980 | Holman | |
| 4,318,327 | A | | 3/1982 | Toups | |
| 4,426,907 | A | * | 1/1984 | Scholz | 84/454 |
| 4,681,010 | A | | 7/1987 | Wilkinson | |
| 4,791,849 | A | | 12/1988 | Kelley | |
| 4,803,908 | A | | 2/1989 | Skinn et al. | |
| 4,909,126 | A | * | 3/1990 | Skinn et al. | 84/454 |
| 5,065,660 | A | | 11/1991 | de Buda | |
| 5,265,513 | A | | 11/1993 | Smith | |
| 5,337,644 | A | | 8/1994 | Fishman et al. | |
| 5,343,793 | A | * | 9/1994 | Pattie | 84/454 |
| 5,390,579 | A | * | 2/1995 | Burgon | 84/454 |
| 5,767,429 | A | * | 6/1998 | Milano et al. | 84/454 |
| 5,986,190 | A | * | 11/1999 | Wolff et al. | 84/297 R |
| 6,184,450 | B1 | * | 2/2001 | LeBlanc | 84/307 |
| 6,184,452 | B1 | * | 2/2001 | Long et al. | 84/457 |
| 6,271,456 | B1 | | 8/2001 | Nelson | |
| 6,278,047 | B1 | * | 8/2001 | Cumberland | 84/455 |
| 2002/0104428 | A1 | | 8/2002 | Wilson | |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner (a)

(b)

(c)

(d)

DEVICE AND METHOD FOR AUTOMATIC TUNING OF A STRING INSTRUMENT IN PARTICULAR A GUITAR

BACKGROUND OF THE INVENTION

The present invention relates to a device for automatic tuning of a string instrument, in particular, a guitar, with a detection device for detecting a tone generated when a string is struck as well as for the output of a digital signal corresponding to the detected tone, memory device for storing preset digital signals, which correspond to a desired tone, comparison device for comparing the digital signal output by the detection device with a digital signal stored in the memory device and corresponding to the desired tone, an adjustment device for changing the tension of the strings, at least one drive for driving the adjustment device and a controller, which is connected to the comparison device and which controls the one or more drives via a bus line with reference to a deviation determined in the comparison device between the signals representing the generated tone and the desired tone. It further relates to a method for automatic tuning of a string instrument, in which a string to be tuned is struck, the tone generated by the string is detected by a detection device and converted into a corresponding first digital signal and the first digital signal is compared with a preset, second digital signal corresponding to a desired tone and a necessary change in the string tension is calculated in a controller from the comparison.

In general, tuning instruments requires, in addition to a trained ear, a large amount of time, especially for untrained, for example, amateur instrumentalists. In the classic method of tuning "by hand," the musician works with a tuning fork, which gives a desired tone when it is struck, and the pitch of the relevant string is adjusted by changing the string length or string tension. By striking the string and the tuning fork several times, the result is equalized until the desired tuning of the string is achieved. Starting from this tuning, the other strings are then tuned.

On the one hand, because the strings of the instrument must always be tuned regularly due to an ever present elasticity of the material and, on the other hand, because the strings are also variable in length as a function of the climatic conditions (on the stage of a concert hall, a guitar string will expand with the heat and humid air in comparison with the conditions in the relatively dry and cool practice room), frequent tuning is necessary. New strings must also be tuned after they are installed.

To create a simplification here, in U.S. Pat. No. 4,803,908 a device for automatic tuning of a string instrument was proposed. In this device, all of the strings are struck simultaneously on a guitar with an aid, which is called "strummer" in this publication and which is arranged in the body of the guitar. Electronics detects the tones, compares them with the desired setting, and controls an adjustment device engaging the strings for adjusting the string tensions, such that they match the preset tones.

The system is very welcome to the extent that it allows easy and automatic tuning and takes away a large amount of work, especially for inexperienced musicians, but also for professionals. The system has a not insignificant disadvantage, however. Overall it is large and clumsy and requires considerable changes to the body of the guitar, which affects, on the one hand, the acoustics (sound) of the guitar and, on the other, the handling of the guitar (due to the changed weight). Apart from these characteristics, the appearance of the guitar is also changed not insignificantly.

Because the entire guitar forms the resonance body that is responsible for the sound characteristics, the sound characteristics also change when the body is changed. Thus, the previously known system is practically impossible to retrofit in existing instruments, but it is also difficult to integrate into new guitars. In particular, in terms of the sound, two guitar types were to be developed independently from each other in the design work, one guitar with the known device and one without.

In WO 03/012774 A1, an electronic device for automatic tuning of a guitar is disclosed, which shows a division of components on the head and the body of the guitar. For this device, for data transfer there is either wiring between the separated components, which represents an intense intrusion into the guitar, with all of the consequences for the guitar sound listed above, or a radio, infrared, or some other type of wireless transmission. For this purpose, however, a corresponding transmitter/receiver must also be attached to the head, which brings with it additional weight and can interfere with the appearance and also the sound response of the guitar. Furthermore, this transmitter/receiver must be provided with a standalone power supply, i.e., a battery or even a power-supply cable connection is to be provided on the head of the guitar.

SUMMARY OF THE INVENTION

The invention starts with the aforementioned problems. The problem of the invention is to present a device that is improved to the extent that it can be integrated into an instrument, in particular, a guitar, with minimal effect on the sound characteristics and with elements that are as few and as small as possible. Furthermore, a method for automatic tuning of a string instrument is to be presented, which satisfies these conditions.

To solve this problem, a device is proposed wherein a controller and one or more drives are arranged in the string instrument on opposite sides of the strings viewed in the longitudinal direction of the strings, characterized in that the bus line between the controller and the one or more drives is represented by at least one of the strings, which is made from a conductive material or which is wound and/or coated with such a material. A method that solves this problem is characterized in that a control signal is output by the controller arranged on a first side viewed in the longitudinal direction of the string to a drive, which is connected to an adjustment device for setting the string tension and which sits on the opposite side viewed in the longitudinal direction of the string, via one or more strings of the string instrument, which are made from a conductive material or which are wound and/or coated with such a material, as bus line(s).

The core concept of the invention is to distribute the components of the device (which, viewed as such, can also be called a system) on the instrument. In a guitar, for example, the entire device is not arranged in the body. Thus, the head or the neck also offers space, even if only a little, for (unobtrusive) mounting of additional components. In particular, the device can resort to using means already arranged on the head of guitars for adjusting the string length or tension, which reduces the use of special parts. Overall, in the instrument, for example, the guitar, fewer additional components must be installed.

To be able to separate the control and drive components without far-reaching intrusion into the instrument body, according to the invention, the control signals are guided between the controller sitting on one instrument part and the one or more drive via at least one string of the guitar acting as a bus line.

In many cases, the strings of string instruments are composed of a conductive material (metal) or are wound by a thread made from such a material. Alternatively, if the sound allows, they can be coated with a conductive material. This solution spares the use of additional lines that must be laid in the instrument body. In this way, in addition to the sound characteristics, not least of all the appearance of the instrument is maintained. If several strings are to be used as wires, to ensure that these strings are not electrically short-circuited to each other, elements guiding the strings together (for example, the bridge of a guitar) must be constructed so that they insulate the strings from each other. For this purpose, these elements can be fabricated from a non-conductive material (for example, ceramic) or can be coated with such a material or other precautions for insulation must be taken (for example, intermediate insulating disks, etc.).

The drive can be a motor, for example, an electric motor, but it can also operate pneumatically or hydraulically.

If the instrument is an instrument electrically connected to an amplifier (e.g., an electric guitar), then an already present pickup, which is connected to the amplifier and which is part of the instrument, can be used as (part of) the detection unit.

As in the improvement according to one embodiment of the invention, if the power supply for the one or more drives is also guided via at least one of the strings, then a separate power supply (battery or the like), which would lead to an additional component with all of the negative consequences for the appearance and the balance of the instrument, does not have to be supplied on the side of the drive, nor does a separate power-supply line, which would lead to the disadvantages already named above, have to be laid.

Through a construction of the controller as given in one embodiment of the invention, the controller can be activated in a simple way by striking one string.

An interface, as can be provided according to one embodiment of the invention, gives the ability to feed software into the device from the outside—also at a later time. Furthermore, different reference tunings can be input into the memory device via the interface in order to be able to tune the instrument according to different tunings.

A construction of the device as proposed in one embodiment of the invention allows string-by-string tuning of the instrument. A drive, which can be switched by means of corresponding gears or similar devices for adjusting each string, can also be used just as well.

In one embodiment an especially compact construction is provided. If the individual components are selected to be as small as possible, they practically "disappear" into the overall appearance of the instrument and also do not interfere with the musician when he or she is playing. In addition, it is not necessary to attach external components for tuning the instrument. The musician can tune his instrument practically anywhere and nearly independently.

One improvement of the device according to one embodiment of the invention produces a redundant system. The device can also continue to operate for tuning the instrument even if one string is defective.

In one embodiment of the invention, a preferred construction of the device is given for integration into an electric guitar.

In embodiments of the invention the strings of the instrument can be used as bus lines. In this way, separate cables or other transmission means (radio, infrared) need not be installed.

Processing of the first digital signal as required in an improvement of the method according to one embodiment of the invention can be useful to be able reliably to determine a pitch from this signal.

The bass frequency (pitch) of the first digital signal is determined preferably with the aid of a mathematical frequency filter in an embodiment of the invention. In contrast to the otherwise common method of fast Fourier transform (FFT), this filter allows a faster and more precise frequency determination from only one strike of a string. This is important, because when a string is struck only one time, the harmonics, which must be detected for an exact determination of the pitch (frequency), die away very quickly.

DETAILED DESCRIPTION OF THE INVENTION

Figure 1:
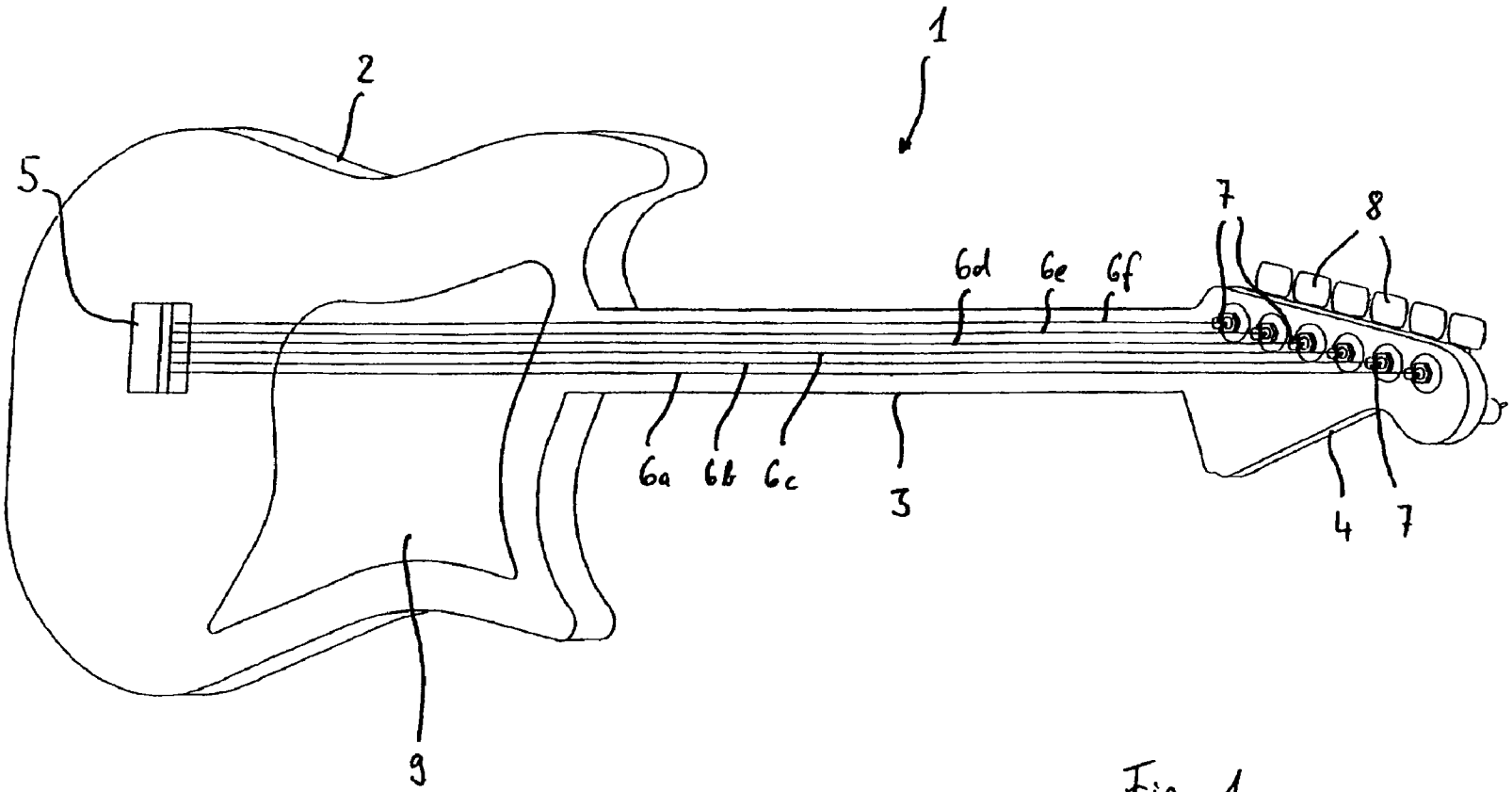
FIG. 1, a schematic view of an electric guitar from the front as a possible embodiment of the invention, FIG. 2, a schematic view of the electric guitar from FIG. 1 from behind, FIG. 3, another schematic view of the electric guitar with other details, FIG. 4, an enlarged representation of the body of the electric guitar according to the representation in FIG. 3, FIG. 5, in four different representations (*a*)-(*d*), a saddle of the tremolo system block of the electric guitar, FIG. 6, schematically the attachment of the strings in the tremolo system block, as well as their contact with the power-supply or signal lines, FIG. 7, in four different views (*a*)-(*d*), the head of the guitar with attached pegs and actuators for setting the string tension, FIG. 8, in four different views, the pegs sitting in the head of the guitar with the servomotors, and FIG. 9, a schematic circuit diagram of a detector circuit for controlling tone-wire feeding for the device for automatic tuning of the guitar.

In the FIGS, the invention is explained with reference to an embodiment for an electric guitar. Identical elements are provided with identical reference symbols in the figures. The description with reference to an electric guitar does not limit the invention. It can be used just as well for acoustic guitars, electric bass guitars, or other electric or electric-acoustic or acoustic string instruments, such as violins, harps, etc.

In FIGS. 1-4, an electric guitar 1, which is provided with a device according to the invention, is shown in different, partially enlarged views. The electric guitar 1 can be divided roughly into the body 2, the neck 3, and the head 4. On the body, the strings 6*a*-6*f* are fixed with their first ends (ball ends) to the so-called tremolo system block 5 and set in tension one next to the other over the neck 3 up to the head 4, where they are wound on adjuster devices 7 with their second ends and can be adjusted. The adjuster devices 7 are connected mechanically to tuning pegs 8, so that by turning the tuning pegs 8, the string end on the adjuster device 7 can be wound onto this head or unwound from this head. In this way, the tension or length of the string is changed and the guitar is tuned.

In FIG. 1, a so-called pick guard 9 can also be seen, which is a kind of covering plate and under which, in the body 2, a space is created, in which the electronics of the electric guitar 1 are arranged. Underneath this pick guard 9 there is a controller chip, which is part of the device according to the invention and which is indicated schematically by numeral 10 in FIG. 2.

Figure 2:
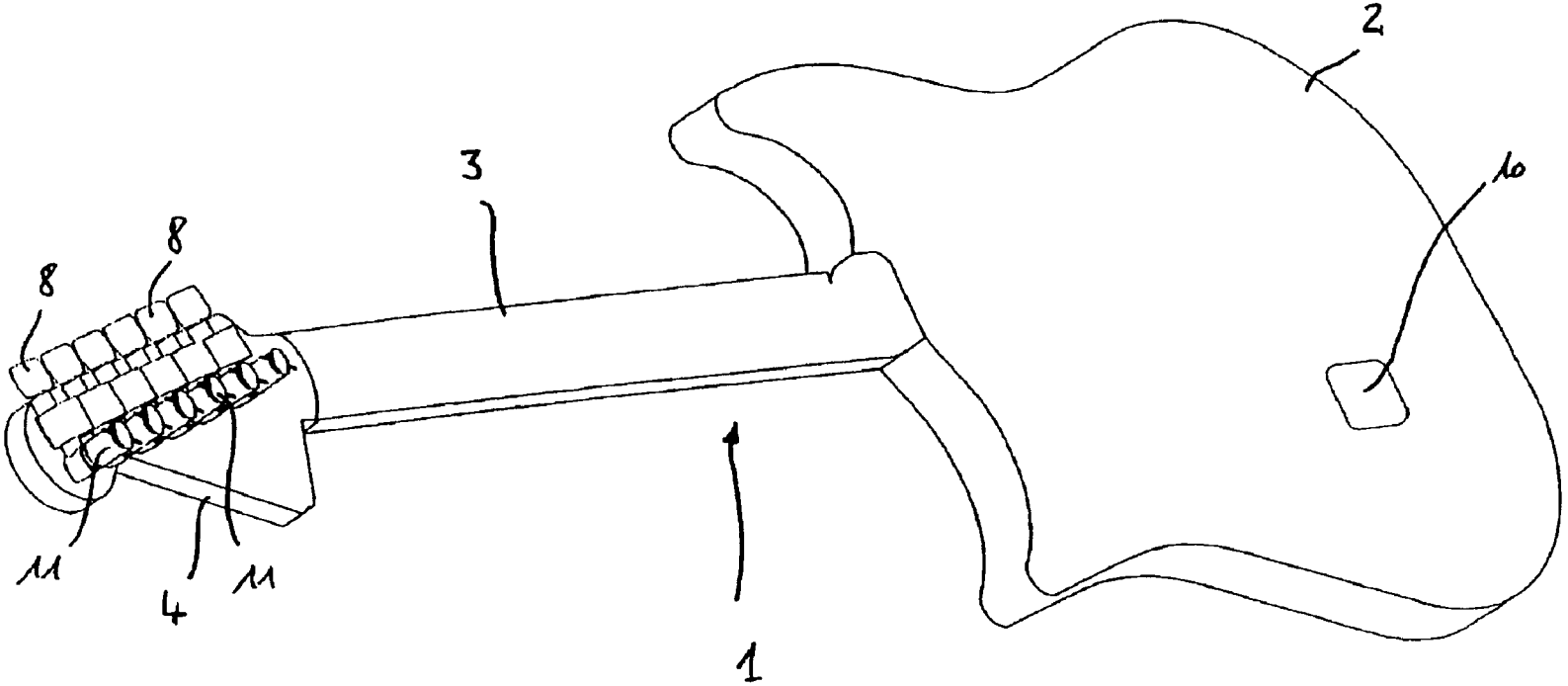

In FIG. 2, it can also be seen that actuators 11 engaging with the mechanism of the tuning pegs 8, for example, by means of gears, are arranged on the head 4 of the electric guitar 1. The actuators belong to the device according to the invention and are connected to the controller chip 10 for control in a way still to be described below. As an alternative to the hand operation by means of the tuning pegs 8, the adjuster devices 7 can be turned with the motors and thus the tension of the strings 6*a*-6*f* can be adjusted.

Figure 3:
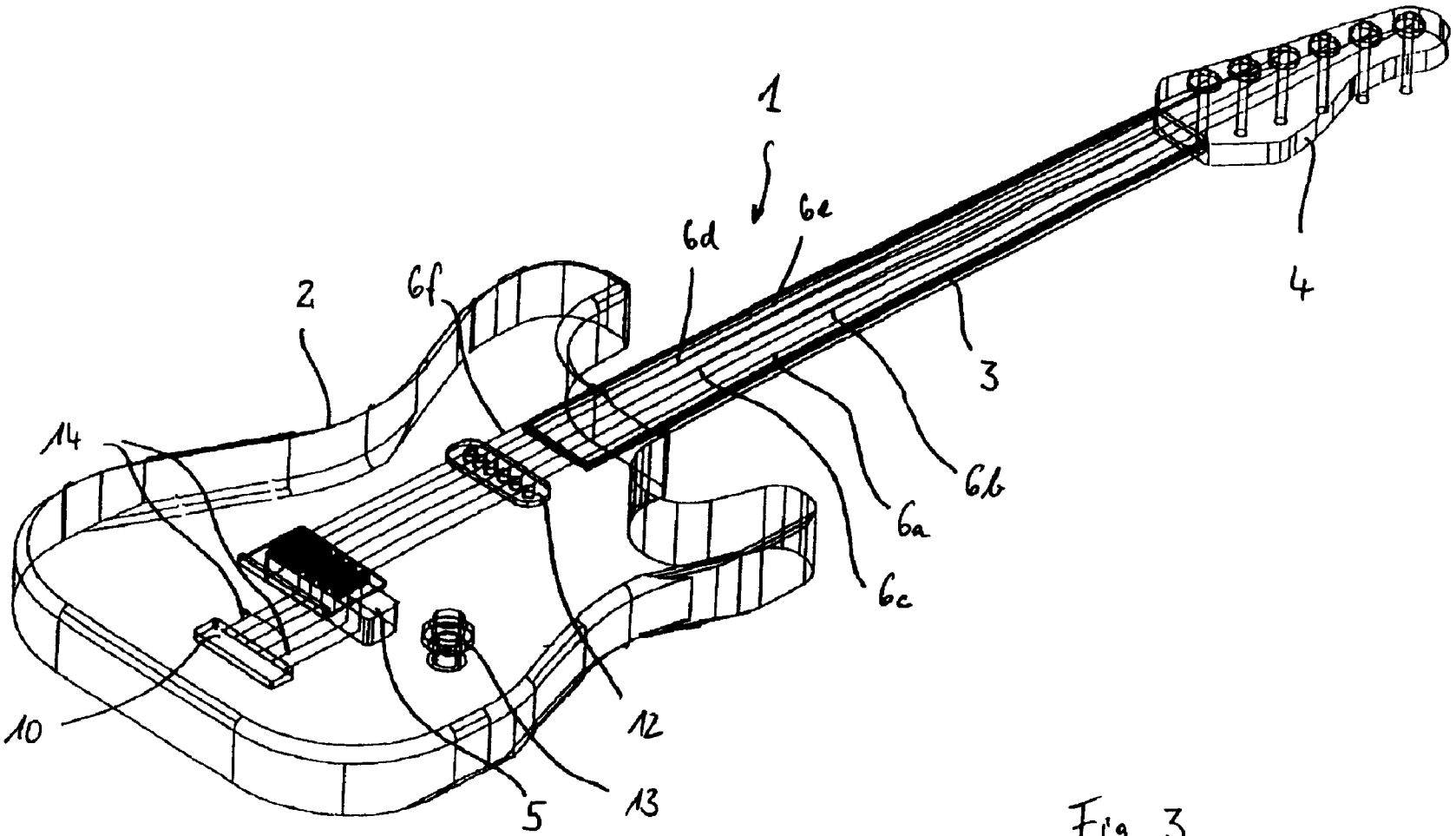
Figure 4:
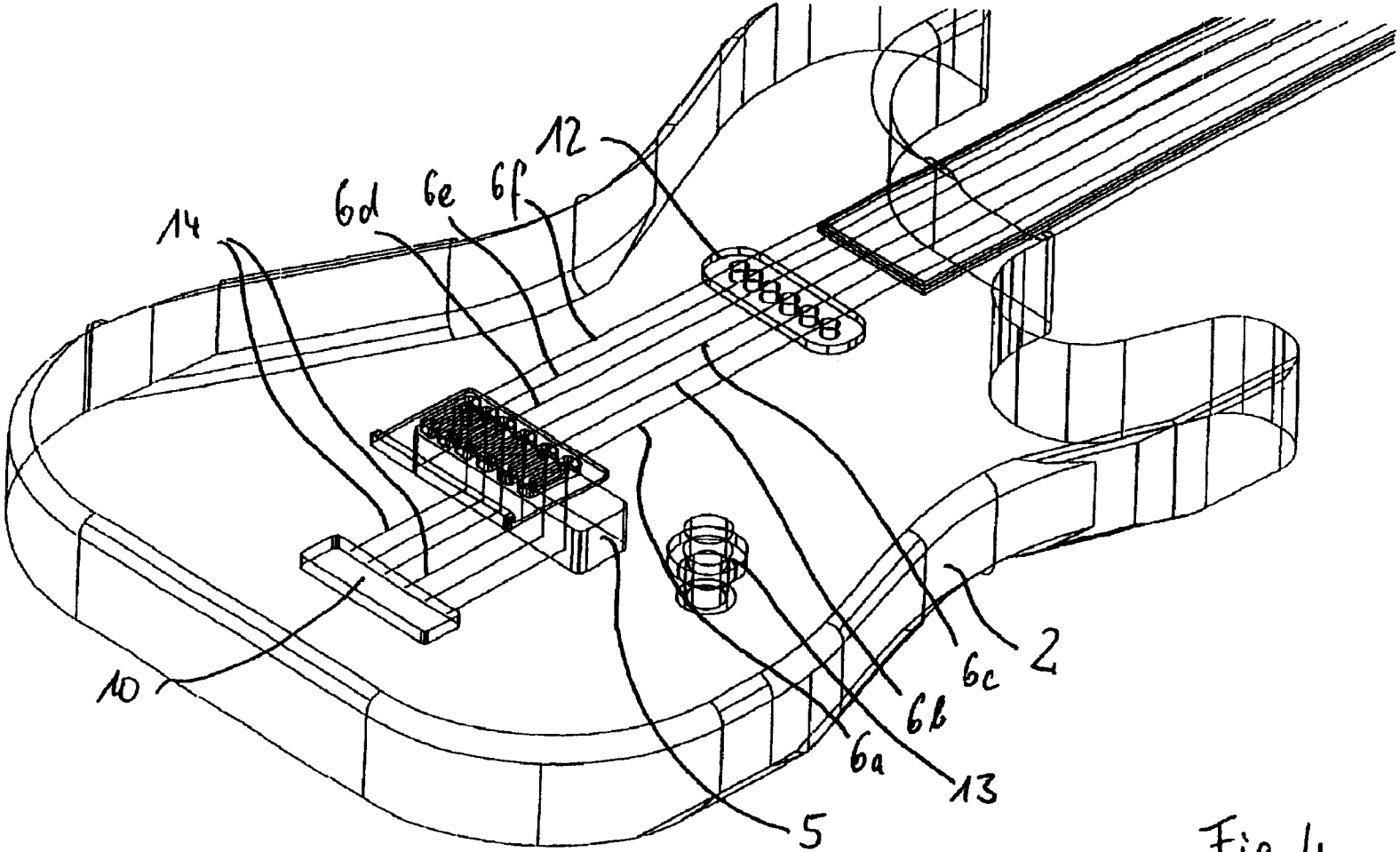

In FIGS. 3 and 4, the electric guitar 1 is shown in a different representation. Here, in addition to the elements to be seen in FIGS. 1 and 2, other details of the electric guitar 1 are shown. For example, the pickups 12 sitting on the body 2 underneath the strings 6*a*-6*f* can be seen, which convert the vibrations of the strings (and thus the tone generated by striking these strings) into an electronic signal. These pickups 12 are simultaneously used in a way still to be described below as a component of the device according to the invention.

Furthermore, in these representations, a potentiometer 13 is shown. Usually, electric guitars provide several such potentiometers for setting the treble, bass, and volume levels. Here, the shown potentiometer 13 is the volume regulator. This special regulator is not constructed as a conventional potentiometer for integration of the device according to the invention in the electric guitar 1, but instead as a so-called push-pull potentiometer, which has an additional switching function.

Finally, still to be seen in these figures are the lines 14 leading from the controller chip to the tremolo system block 5, more precisely to the strings 6*a*-6*f*.

Figure 5:
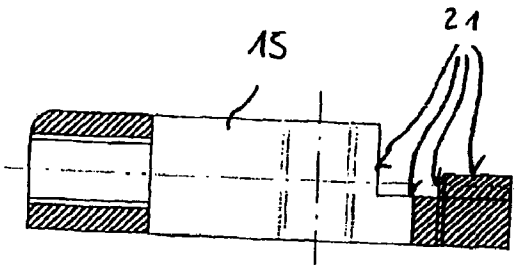
Figure 5:
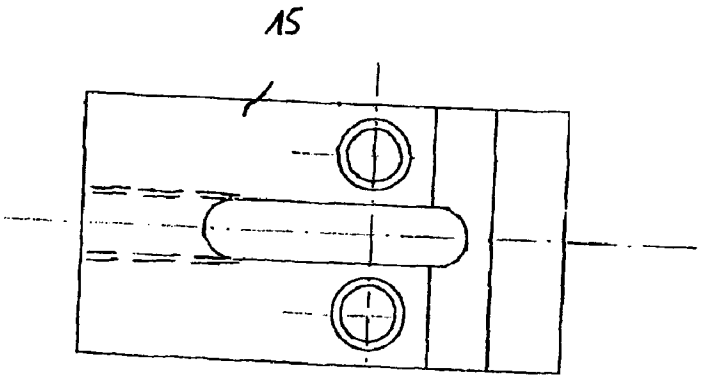
Figure 5:
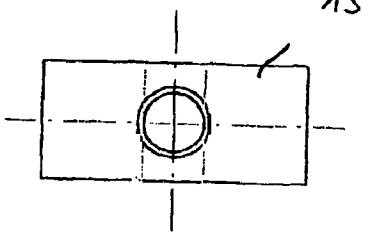
Figure 5:
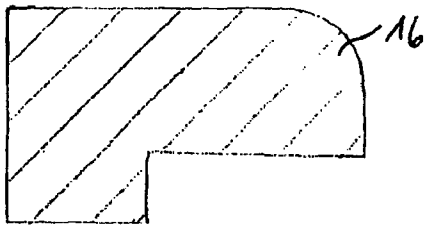
Figure 6:
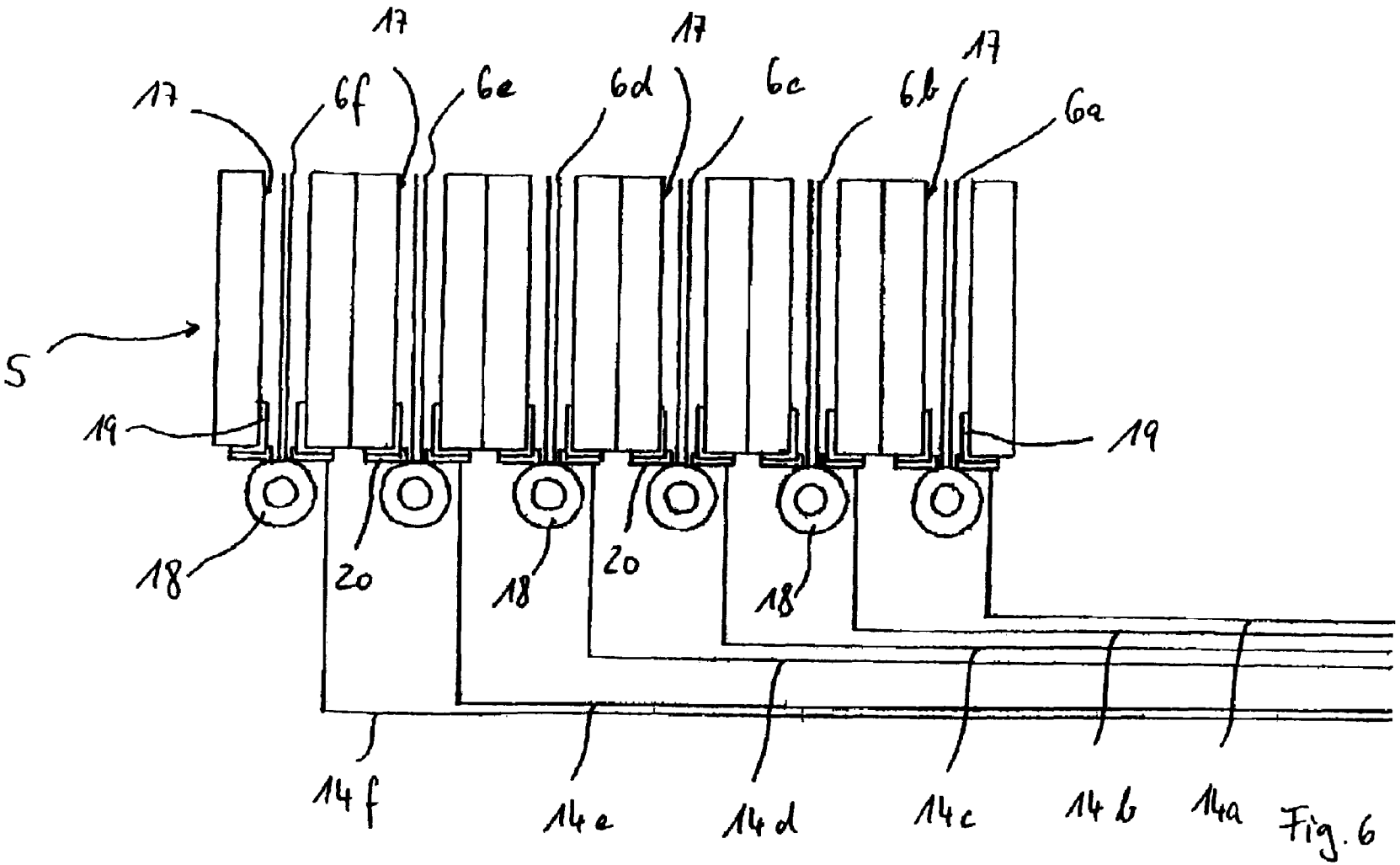

In FIGS. 5 and 6, the tremolo system block 5 and a saddle 15 arranged on this block for guiding the string ends fixed in the tremolo system block 5 are shown, respectively. In FIG. 6 it can be seen how the strings 6*a*-6*f* are guided through bores 17 in the tremolo system block 15 and are held at the bottom edge of the bores 17 with thick sections (ball ends) 18 at their ends. An insulating sleeve 19, which is provided on its edge projecting out of the bore 17 with an outwardly pointing flange, is inserted into the bottom end of the bores 17. Conductive disks 20, which contact the thick sections (ball ends) 18 of the strings 6*a*-6*f*, are positioned between the flanges of the sleeves 19 and the thick sections (ball ends) 18. These disks are connected, in turn, with the lines 14 (shown here as 14*a*-14*f*) connected to the controller chip 10.

In this way, the strings 6*a*-6*f* of the electric guitar 1, which are made from a conductive metal or are wound with a conductive metal thread, are electrically connected to the controller chip 10.

The saddles 15 shown in FIGS. 5(*a*)-5(*d*) are mounted on the tremolo system block 5. The strings run over these saddles in the region of the saddle inserts designated by numeral 16. The saddle insert shown enlarged in FIG. 5(*d*) is inserted into the saddle shown in FIG. 5(*a*) into the recess shown on the right in FIG. 5(*a*). Because the saddle 15 and the saddle inserts 16 in an electric guitar 1 are normally composed of metal and thus of a conductive material, the saddle inserts 16, over which the strings 6*a*-6*f* run, must be insulated from each other, in order to prevent a short circuit between the strings, which contact each other electrically via the lines 14. For this purpose, the surfaces designated by numeral 21 in FIG. 5(*a*) are insulated.

Figure 7:
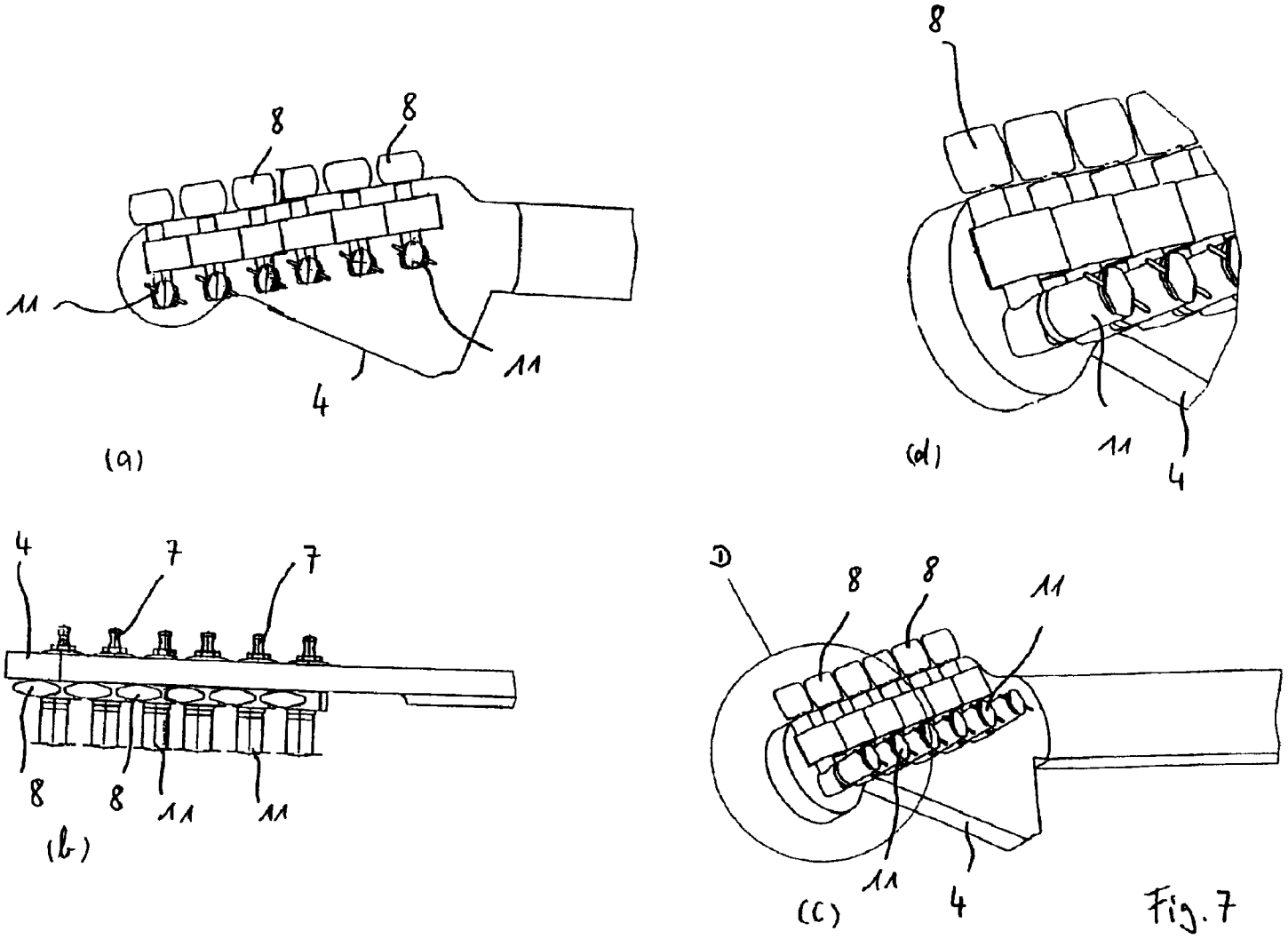

In FIGS. 7(*a*)-7(*d*), details of the head 4 of the electric guitar 1 can be seen again with the attached components of the device according to the invention, with FIG. 7(*d*) representing a detail enlargement of the region designated with D in FIG. 7(*c*).

Figure 8:
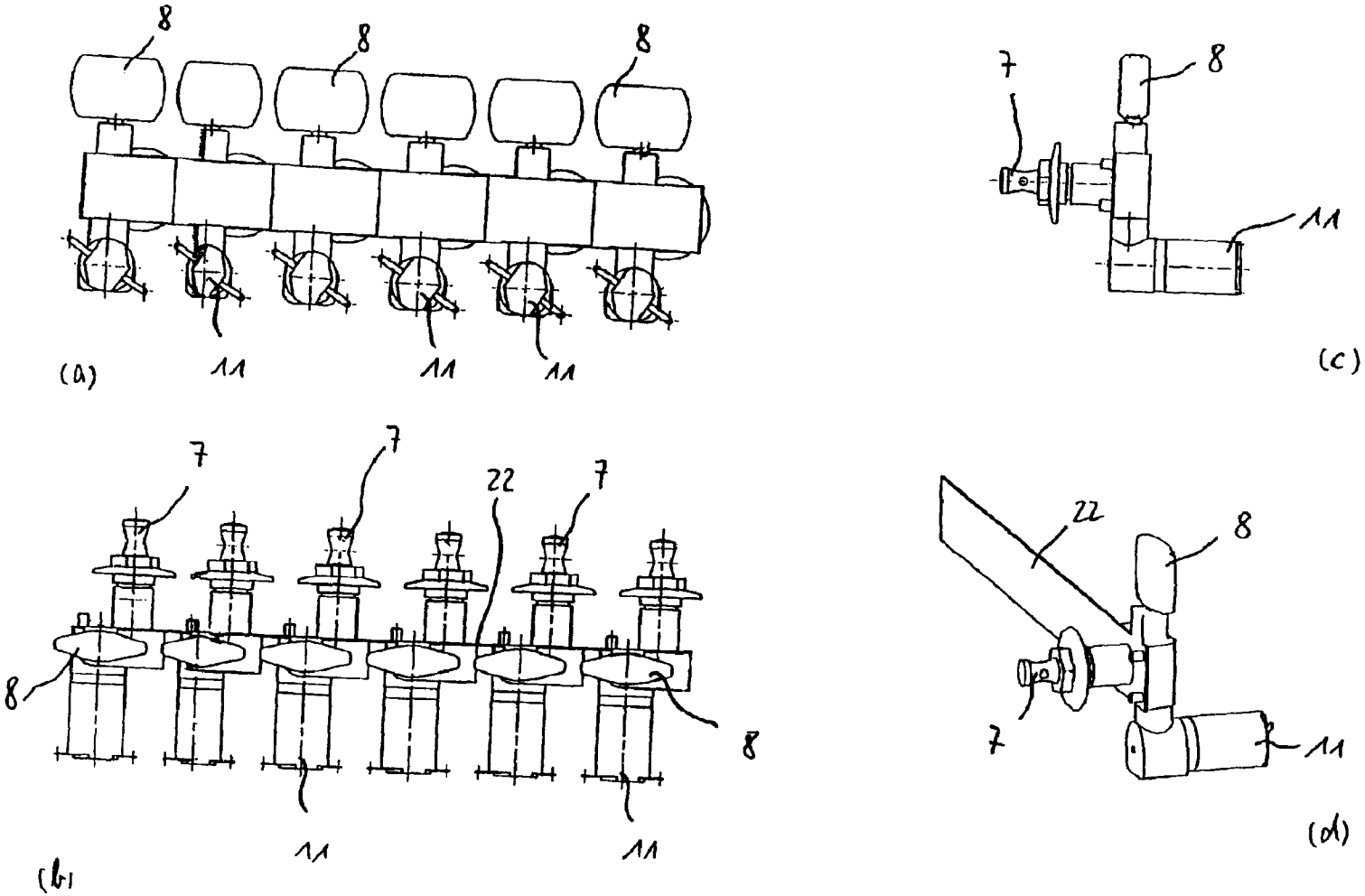

In FIGS. 8(*a*)-8(*d*), the mechanical units for adjusting the string tension are shown, comprising the adjuster devices 7, the tuning pegs 8, and the actuators 11 disengaged from the head 4. One notes that all of these units sit on a common circuit board 22, which contains additional control elements for controlling the actuators 11. The strings are electrically connected to corresponding conductor tracks on the circuit board 22 via the metallic and thus conductive adjuster devices 7.

Figure 9:
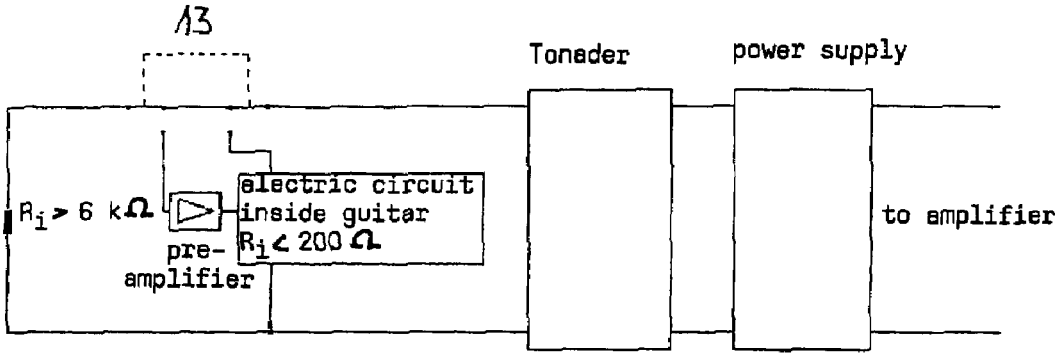

The device according to the invention for automatic tuning of the electric guitar 1 operates as follows:

By pulling the push-pull potentiometer 13, the system is activated. Here, reference is made to the circuit shown in FIG. 9, which will be described below.

Commands can now be issued to the controller chip 10 by striking one of the strings. The tones generated by striking the strings are converted by the pickups 12 into an electronic signal, which is converted to a frequency in the controller. Defined pre-programmed commands, which are called at a frequency lying within a certain tolerance, are stored in the controller. In this way, for example, the program for tuning one of the strings, e.g., the e-string 6*f*, can be called. If the program is activated, then the controller chip loads a reference frequency for this string, which is used as a desired frequency, from a memory. The string is now optionally struck again, the actual frequency is calculated from the signal converted by the pickup 12 in the controller chip 10, and a signal is sent to the circuit board 22 or via this circuit board to the corresponding actuator 11 via the strings used as bus lines for adjusting the string tension for reaching the desired frequency. Here, the controller chip 10 monitors the change in frequency and outputs a stop signal to the actuator 11 when the desired frequency is reached. In this way, all of the strings can be tuned one after the other. A mathematical frequency filter is used as the routine for calculating the actual frequency from the electronic signal of the pickups, because this can calculate the frequency especially quickly and reliably.

By means of an interface not shown in the figures, different frequency defaults for the strings can be given to the controller chip 10 according to which type of tuning has currently been selected (for example, open tuning, etc.).

For transmitting the control signals, only two of the strings are needed. By means of two other strings, here the strings 6*f* (low e-string) and 6*e* (a-string), the power supply for the circuit board 22 and the actuators 11 are brought to the head 4, so that a separate power source is not necessary there. The strings 6*f* and 6*e* are selected for transmitting the voltage, because the low e-string and the a-string are the thickest strings of the electric guitar 1 and thus very rarely break. Of the remaining four strings 6*a*-6*d*, any two can be freely controlled by the controller chip 10 as bus lines. In this way, the system is redundant and can still operate if one or even two of the strings 6*a*-6*d* break.

Light-emitting diodes on the body 2, for example, in the area of the pickups 12 underneath the strings 6*a*-6*f* can display the state of the controller chip 10 or the program sequence and thus simplify the handling of the device. Here, "brief instructions" as to which commands are called can also be displayed, e.g., on the display, by striking which of the strings 6*a*-6*f* in which tone [sic]. The frequencies allocated to the commands can be managed by the controller chip 10, so that they are adapted to the current tuning of the electric guitar, that is, the user must always strike the same string with the same grip in order to call a command, regardless of how the guitar and thus the string has just been tuned.

In this embodiment, the power supply for the system is realized externally, that is, via the amplifier cable, with which the guitar is already electrically connected to an amplifier. The tone wire circuit shown in FIG. 9 constantly monitors the internal resistance of the electric guitar 1. For normal, ready-to-play electric guitars 1, this resistance is high. If the musician now pulls the push-pull potentiometer 13, then this decoupled the pickup 12 from the jack socket for the amplifier cable and thus from the amplifier and activates the controller chip 10. In this way, the internal resistance of the electric guitar 1 decreases by a factor of at least 20. This circuit detects this condition and disconnects the amplifier cable, for one, from the amplifier, so that the electric guitar 1 can be tuned in a "muted" state. Furthermore, the circuit switches a power supply voltage onto the amplifier cable, which can be obtained, for example, from the power supply part of the amplifier but also from an external power supply part. This voltage is then fed to the controller 10 and forwarded into the head 4 via the strings 6*e* and 6*f*. The device according to the invention can now function. After the tuning is complete or, for example, the circuit is installed or new data is entered, the musician switches the push-pull potentiometer 13 back into the normal position. The internal resistance of the electric guitar 1 increases through the pickup 12 now reconnected to the amplifier cable. This is detected by the tone wire circuit according to FIG. 9 and outputs the signals from the amplifier cable back to the amplifier, so that the musician can continue to play.

LIST OF REFERENCE SYMBOLS

1 Electric guitar
2 Body
3 Neck
4 Head
5 Tremolo system block
6*a-f* String
7 Adjuster device
8 Tuning peg
9 Pick guard
10 Controller chip
11 Actuator
12 Pickup
13 Potentiometer
14 Line
15 Saddle
16 Saddle insert
17 Bore
18 Thick section
19 Sleeve
20 Disk
21 Surface
22 Circuit board

The invention claimed is:

1. Device for automatic tuning of a string instrument, in particular, a guitar, comprising:

a) a detection device detecting a tone generated when a string is struck and outputting a digital signal corresponding to the detected tone, b) a memory device storing preset digital signals, which correspond to a desired tone, c) a comparison device comparing the digital signal output by the detection device with a digital signal stored in the memory device and corresponding to the desired tone, d) an adjustment device changing the tension of one or more strings, e) one or more drives driving the adjustment device, and f) a controller connected to the comparison device and controlling the one or more drives via a bus line transmitting control signals with reference to a deviation determined in the comparison device between the signals representing the generated tone and the desired tone, wherein the controller and the one or more drives are arranged in the string instrument on opposite ends of one or more of the strings viewed in the longitudinal direction of the strings, and wherein the bus line between the controller and the one or more drives includes at least one of the group consisting of a string made from a conductive material, a string coated with a conductive material and a string wound with a conductive material.

2. Device according to claim 1, further comprising a power supply of the one or more drives coupled to at least one of a string made from a conductive material, a string coated with a conductive material and a string wound with a conductive material.

3. Device according to claim 1, wherein the detection device is operatively coupled to and switches the controller upon output of a digital signal representing a tone lying within a tolerance span.

4. Device according to claim 1, further comprising an interface for data exchange.

5. Device according to claim 1, further comprising a plurality of adjustment devices and each string operatively coupled to an adjustment device with a drive.

6. Device according to claim 1, wherein the detection device, memory device, comparison device, adjustment device, drive, and controller are integrated into a string instrument.

7. Device according to claim 1 wherein the controller is operatively coupled to and selects at least one of an alternative string as the bus line and an alternative string as a power line upon detecting a defect in at least one of a first string used as a bus line and another string used as a power line.

8. Device according to claim 6, wherein the string instrument is a guitar including a body and neck and the controller is arranged on the body of the guitar and the adjustment device and the one or more drives are arranged at the top end of the neck and the one or more drives are connected to the controller via one or more strings used as one or more bus lines running along the neck.

9. Method for automatic tuning of a string instrument comprising:

striking a string to be tuned, detecting a tone generated and converting said tone into a corresponding first digital signal, comparing the first digital signal with a predetermined second digital signal corresponding to a desired tone and calculating a change in the string tension from the comparison, and outputting a control signal from a controller arranged on a first end viewed in the longitudinal direction of the string to a drive that sets the string tension from a connected adjustment device on the opposite end viewed in the longitudinal direction of the string, via a bus line that includes at least one of the group consisting of a string made from a conductive material, a string which is wound with a conductive material, and a string coated with a conductive material.

10. Method according to claim 9, preparing the first digital signal for further processing.

11. Method according to claim 10, further comprising determining frequency of the tone generated from the first digital signal with a mathematical frequency filter and wherein the second digital signal corresponds to a preset frequency.

* * * * *